US007173591B2

(12) United States Patent
Monomohshi

(10) Patent No.: US 7,173,591 B2
(45) Date of Patent: Feb. 6, 2007

(54) LIQUID CRYSTAL DRIVING DEVICE

(75) Inventor: Masahiko Monomohshi, Kashihara (JP)

(73) Assignee: Sharp Kabushiki Kaisha, Osaka (JP)

( * ) Notice: Subject to any disclaimer, the term of this patent is extended or adjusted under 35 U.S.C. 154(b) by 628 days.

(21) Appl. No.: 10/704,978

(22) Filed: Nov. 12, 2003

(65) Prior Publication Data

US 2004/0104874 A1 Jun. 3, 2004

(30) Foreign Application Priority Data

Nov. 28, 2002 (JP) ..... 2002-346382

(51) Int. Cl.
*G09G 3/36* (2006.01)

(52) U.S. Cl. ..... 345/96; 345/99

(58) Field of Classification Search ..... 345/94, 345/96, 99, 209

See application file for complete search history.

(56) References Cited

U.S. PATENT DOCUMENTS 5,828,357 A * 10/1998 Tamai et al. ..... 345/89
6,040,813 A * 3/2000 Takubo ..... 345/92
6,570,549 B2 * 5/2003 Nakanishi et al. ..... 345/87
6,914,589 B2 * 7/2005 Choi ..... 345/96

FOREIGN PATENT DOCUMENTS

JP 2000-267618 9/2000

* cited by examiner

*Primary Examiner*—Kent Chang
(74) *Attorney, Agent, or Firm*—Harness, Dickey & Pierce, P.L.C.

(57) ABSTRACT

A liquid crystal driving device in accordance with the present invention includes an offset information storing register for storing digital compensation data, an amplitude information storing register, and a variable resistor for adjusting the maximum gradation display voltage and minimum gradation display voltage in order to cause an absolute value of the difference between a voltage applied to a pixel electrode and a voltage applied to a common electrode to be consistent in all frames. With this, the number of components of the liquid crystal driving device can be restrained and the offset adjustment can be easily carried out with low costs.

14 Claims, 11 Drawing Sheets

LIQUID CRYSTAL DRIVING DEVICE

FIELD OF THE INVENTION

The present invention relates to a liquid crystal driving device compensating a liquid crystal driving voltage.

BACKGROUND OF THE INVENTION

FIG. 5 is a block diagram of a conventional TFT liquid crystal display device (a display device adopting a TFT liquid crystal panel) which is a representative example of an active matrix liquid crystal display device. A member 3801 is a TFT liquid crystal panel (including common electrode (opposing electrode)), a block 3802 is a source driver made up of a plurality of source driver ICs 3802-1, 3802-2, . . . , and 3802-n (n is a natural number), a block 3803 is a gate driver made up of a plurality of gate driver ICs 3803-1, 3803-2, . . . , and 3803-m (m is a natural number), a member 3804 is a control circuit (described as controller in FIG. 5), and a member 3805 is a liquid crystal driving power supply (power supply circuit) generating voltages for driving the liquid crystal panel.

The control circuit 3804 supplies control signals such as a vertical synchronizing signal and horizontal synchronizing signal to the gate driver 3803, and supplies signals such as a horizontal synchronizing signal, start pulse signal for source driver, and data transfer clock CK to the source driver 3802. Display data supplied from the outside is converted to digital signals (R, G, and B signals) via a control circuit 3804, and fed to the source driver 3802.

FIG. 6 is a block diagram of the source driver IC 3802-1. Note that, since the other source driver ICs 3802-2 through 3802-n are identical with the source driver IC 3802-1, the descriptions thereof are omitted.

The following operations are carried out in the source driver IC 3802-1: The supplied sets of display data (R, G, and B) are latched in an input latch circuit 4401 in a time-division manner. The start pulse signal indicating the data head is transferred to a shift register circuit 4403 in sync with the data transfer clock CK, and in accordance with output signals from respective stages of the shift register circuit 4403, sampling timings of the display data are generated.

The start pulse signal transferred to the shift register circuit 4403 is supplied to the source driver IC 3802-2 which is the next stage, as a cascade output signal.

The sets of display data latched at the above-mentioned sampling timings are stored in a sampling memory 4404, as the output from the source driver IC 3802-1 (i.e. display data for one horizontal synchronizing signal). Then in sync with the horizontal synchronizing signal from the control circuit 3804 (see FIG. 5), the sets of display data having been stored are transferred from the sampling memory 4404 to a hold memory 4405, thereby being latched.

The hold memory 4404 holds the sets of display data for one horizontal synchronizing period until the input of the next horizontal synchronizing signal. The sets of display data are then supplied from the hold memory 4405 to a level shifter circuit 4406. In this level shifter circuit 4406, the signal levels of the sets of display data are shifted (typically boosted) so as to be converted to levels corresponding to the maximum driving voltage of the liquid crystal panel, and subsequently the sets of display data are fed to a D/A conversion circuit 4407.

The D/A conversion circuit 4407 selects, in accordance with the display data, one of a plurality of gradation display voltages supplied from a voltage generation circuit 4402 (which generates voltages for gradation display), and carries out digital/analog conversion.

The selected gradation display voltage is subjected to impedance lowering in an output circuit 4408, thereby being outputted from liquid crystal driving output terminals. The gradation display voltage is generated by the voltage generation circuit 4402. FIG. 11 illustrates a circuit arrangement of this voltage generation circuit 4402.

In FIG. 11, a member 2201 is a circuit generating the maximum voltage VH of the gradation display voltage (hereinafter, maximum gradation display voltage VH) and the minimum voltage VL of the gradation display voltage (hereinafter, minimum gradation display voltage VL). To this circuit 2201, an amplitude compensation voltage and offset compensation voltage obtained by adjusting, in accordance with amplitude information and offset information, variable resistors 2708 and 2709 connected externally to the source driver IC 3802-1 are inputted. These compensation voltages will be specifically described later. In accordance with the compensation voltages, the maximum gradation display voltage VH and minimum gradation display voltage VL are generated in the circuit 2201.

The voltage (VH−VL) is divided into a plurality of voltages in a resistance dividing circuit 2202 of the next stage, so that gradation display voltages (e.g. 64 gradation display voltages for 64 gradation levels) are generated. The number of gradation display voltages corresponds to the number of gradation levels required by the display panel 3801. For instance, when the display panel 3801 displays 64 gradation levels, the voltage (VH−VL) has to be divided into 64 voltages, and when the display panel 3801 displays 256 gradation levels, the voltage (VH−VL) has to be divided into 256 voltages.

In the circuit 2201 in FIG. 11, members 2705 and 2706 are low impedance conversion means which are in this case realized by voltage-follower operational amplifiers.

In the circuit 2201, the offset compensation voltage is converted to the minimum gradation display voltage VL by the voltage-follower operational amplifier 2706. Meanwhile, the amplitude compensation voltage passes through the voltage-follower operational amplifier 2706 and then is divided by resistors 2701 and 2702. A voltage produced as a result of the division is amplified by a noninversion operational amplifier 2707, and then outputted therefrom as the maximum gradation display voltage VH. The resistors 2701, 2702, 2703, and 2704 are arranged to be suitable for obtaining required voltage values.

FIG. 7 illustrates an arrangement of the TFT liquid crystal panel 3801. In the figure, a member 3901 is a pixel electrode, a member 3902 is a pixel capacity, a member 3903 is a TFT (switching element), members 3904 are source signal lines, members 3905 are gate signal lines, and a member 3906 is a common electrode (opposing electrode).

To the source signal lines 3904, gradation display voltages varying in accordance with the brightness of display pixels are supplied from the source driver 3802. To the gate signal lines 3905, scanning signals are supplied from the gate driver 3803, in order to serially turn on a vertical sequence of the TFTs 3903.

Through the TFT 3903 having been turned on, a voltage is supplied from the source signal line 3904 to the pixel electrode 3901 connected to the drain of the TFT 3903, so that an electric charge is charged in the pixel capacity 3902 between the pixel electrode 3901 and opposing electrode 3906. The voltage is held even after the TFT 3903 is turned off, so that the optical transmittance of liquid crystal is changed and gradation displaying is carried out in accordance with the change.

In liquid crystal display devices, AC driving is carried out in order to secure long-term reliability of liquid crystal, in such a manner that a voltage is converted to AC by inverting the polarity thereof at predetermined intervals, so that a DC component is cancelled. As methods of this AC conversion, the following two methods are typically used in TFT liquid crystal panels.

According to the first method, a voltage of the common electrode 3906 of the liquid crystal panel 3801 is stabilized, and a voltage (source electrode voltage in the figure) supplied to the source signal line 3904 is AC-converted in such a manner that a positive voltage and negative voltage are alternately supplied to the common electrode 3906.

FIG. 8 illustrates a driving method in accordance with the above-described first method. The figure shows the variation of a voltage supplied to one pixel. In this case, on the one hand a voltage (indicated by a dotted line in the figure) of the common electrode 3906 is stabilized, on the other hand a voltage of the source electrode (pixel electrode 3901) is varied in each frame so as to be positive or negative with respect to the common electrode 3906, so that the AC driving is carried out. Since the optical transmittance of a liquid crystal pixel is determined by an absolute value of a voltage, the voltage applied to the liquid crystal pixel in this case is |V| in all frames, and thus the optical transmittance of the pixel is always at a constant value in all frames.

According to the second method, respective voltages applied to the common electrode 3906 and source signal line 3904 of the liquid crystal panel 3801 (the voltage applied to the latter is indicated as source electrode voltage in the figure) are both varied so as to be AC-converted.

FIG. 9 illustrates a driving method in accordance with the above-described second method. This figure shows the variation of a voltage applied to one pixel, and the AC conversion is carried out in the following manner: The voltage applied to the common electrode 3906 is switched between 0 (volt) and +V (volt) in each frame of the screen, while the voltage applied to the source electrode (pixel electrode 3901) is switched between +V (volt) and 0 (volt).

When the voltage of the common electrode 3906 is 0 (volt), the voltage applied to the source electrode (pixel electrode 3901) is positive with respect to the common electrode 3906. Meanwhile, when the voltage of the common electrode 3906 is +V, the voltage applied to the source electrode is negative with respect to the common electrode 3906. In this manner, according to the second method, the voltages applied to the common electrode 3906 and source electrode, respectively, are varied so that the voltage applied to the source electrode is half as much as the voltage in the first method.

To carry out the liquid crystal driving, a voltage which is about 5V higher or lower than the voltage of the common electrode 3906 is required. The liquid crystal driving is typically carried out in such a manner that a voltage which is positive and negative with respect to the voltage of the common electrode 3906 is alternately supplied to the source electrode. According to the first method, while the display control is easily performed thanks to the stabilized voltage of the common electrode 3906, it is necessary to additionally provide a driving circuit which can generate a voltage of about 10V, in order to change the voltage for driving the source electrode (pixel electrode 3901), for instance, within the range between −5V and 5V (when the common electrode voltage is 0V) or within the range between 0V and 10V (when the common electrode voltage is 5V).

In the meantime, according to the second method, the voltage of the common electrode 3906 is varied so that the display control circuit has to be complex in structure, but a driving circuit for 5V, which is usually cheap, can be adopted. In other words, a low voltage resistant process as in the case of typical logic circuits can be adopted, thereby a high voltage resistant process not being required.

Now, the liquid crystal driving in accordance with the second method will be described. Concerning the variation of the voltage of the common electrode 3906 as in FIG. 9, FIG. 10 shows a case when an absolute value of the difference between the maximum gradation display voltage VH applied to the source electrode (pixel electrode 3901) and the voltage applied to the common electrode 3906 is not equal to an absolute value of the difference between the minimum gradation display voltage VL and the voltage applied to the common electrode 3906. In short, FIG. 10 shows a case when these absolute values have an offset. In this case, since an absolute value of the positive voltage is different from an absolute value of the negative voltage, the optical transmittance of the liquid crystal pixel varies in each frame, causing significant deterioration of display quality.

Thus, it is necessary to adjust the maximum gradation display voltage VH and minimum gradation display voltage VL so as to be equal to the level of the voltage applied to the common electrode 3906.

In connection with this, Japanese Laid-Open Patent Application No. 2000-267618 (Tokukai 2000-267618; published on Sep. 29, 2000) discloses a method of adjusting a voltage of a common electrode in order to prevent the variation of a liquid crystal driving waveform, which is caused by a voltage generated due to a parasitic capacity, from influencing on the displaying. In this manner, when an absolute value of the difference between the maximum gradation display voltage VH applied to the source electrode and the voltage applied to the common electrode is not equal to an absolute value of the difference between the minimum gradation display voltage VL and the voltage applied to the common electrode, the display quality is deteriorated.

Even after the maximum gradation display voltage VH and minimum gradation display voltage VL are modified so as to be equal to the level of the voltage applied to the common electrode, the voltage may be varied due to reasons such as noise, the adjustment of the voltages VH and VL is a very important matter.

The amplitude information and offset information have conventionally been obtained by checking the display quality by, for instance, visual observation, or by actually performing voltage measurement. Then, as in FIGS. 6 and 11, the variable resistors 2708 and 2709 connected to the outside of the source driver IC adjust the amplitude compensation voltage and offset compensation voltage, respectively, and adjust the maximum gradation display voltage VH and minimum gradation display voltage VL both applied to the source electrode. Through these operations, the improvement of the display quality has conventionally been carried out.

The foregoing description with reference to FIGS. 6 and 11 does not mention compensation voltages. It is noted here that the compensation voltages are, as described above, the amplitude compensation voltage and offset compensation voltage which compensate the state shown in FIG. 10 and cause an absolute value of a positive voltage and an absolute value of a negative voltage to be identical with each other.

Now, the operation of a conventional circuit is described with reference to FIG. 11. First, as the starting point, the maximum gradation display voltage VH and minimum gradation display voltage VL are determined as, for instance, 5V and 0V. Since this determines an amplitude voltage (=VH−VL) to be 5V, an amplitude compensation voltage is determined to be 5V and an offset compensation voltage is determined to be 0V.

An output voltage from the operational amplifier 2705 is 5V and an output voltage from the operational amplifier 2706 is 0V. Thus, provided that the resistors 2701 and 2702 have identical resistance values, a noninversion amplifier terminal (positive input terminal) of the operational amplifier 2707 receives a voltage of 2.5V. The operational amplifier 2707 and resistors 2703 and 2704 constitute a noninversion amplifier circuit, and produce an output voltage twice as much as the input voltage thereto, when the resistors 2701 and 2702 have identical resistance values. Thus, the maximum gradation display voltage VH is 5V.

Meanwhile, since a voltage equal to the voltage applied to the noninversion amplifier terminal of the operational amplifier 2706 is outputted from an output terminal of the operational amplifier 2706, the minimum gradation display voltage VL is 0V. The voltage range between the maximum gradation display voltage VH and minimum gradation display voltage VL is divided so that a plurality of gradation display voltages are generated in the resistance dividing circuit 2202.

In this case, it is desirable that the voltage applied to the common electrode has an amplitude waveform within the range of 0–5V. Thus, the description above assumes that an amplitude waveform within the range of 0.2–4.8V is applied to the common electrode. Further, in FIG. 11, assume that the resistors 2701 and 2702 have identical resistance values and the resistors 2703 and 2704 also have identical resistance values.

Since the amplitude information is 4.6V (=4.8−0.2) and the offset information is 0.2V, the variable resistor 2708 is adjusted so that the amplitude compensation voltage is varied to 4.6V, and the variable resistor 2709 is adjusted so that the offset compensation voltage is varied to 0.2V.

On the ground of the superposition principle and the relationship between the resistors 2701 and 2702, a half of the amplitude compensation voltage (4.6V), i.e. 2.3V and a half of the offset compensation voltage, i.e. 0.1V are supplied to the noninversion input terminal of the operational amplifier 2707. Then these voltages (2.3V and 0.1V) are both doubled in the operational amplifier 2707, and as the maximum gradation display voltage VH, a voltage of 4.8V is supplied from the output terminal of the operational amplifier 2707 to the resistance dividing circuit 2202. The minimum gradation display voltage VL on this occasion is 0.2V.

In this manner, the maximum gradation display voltage VH and minimum gradation display voltage VL are compensated using the amplitude information and offset information of the voltage supplied to the common electrode, so that it is possible to cause the above-mentioned positive voltage and negative voltage to have identical absolute values.

However, the above-described conventional art has the following problem.

In the conventional art described in FIGS. 6 and 11, members such as a liquid crystal driver (e.g. source driver 3802) are mounted on the display panel 3801, the display quality is checked, and then the offset compensation is carried out by adjusting the respective variable resistors 2708 and 2709. Thus, since external voltage compensation members such as the variable resistors 2708 and 2709 are required for each source driver IC, the number of components increases and hence the manufacturing costs increase.

Furthermore, the conventional art requires a mechanism for conducting the adjustment after mounting the components, and this limits the design flexibility of the module.

Moreover, since the adjustment of the offset voltage by the external voltage compensation members is required for each end product, cumbersome operations are additionally required.

SUMMARY OF THE INVENTION

The present invention is done to solve the above-identified problems. The objectives of the present invention are to provide a liquid crystal driving device in which the number of components is restrained and the offset adjustment is easily carried out with low costs.

To achieve this objectives, the liquid crystal driving device in accordance with the present invention, which drives a liquid crystal pixel between a pixel electrode and common electrode opposing the pixel electrode, by carrying out AC conversion by changing a first voltage for gradation displaying and a second voltage on a frame-by-frame basis, the first voltage changing in accordance with display data and being applied to the pixel electrode and the second voltage being applied to the common electrode, comprises: storing means for storing compensation data; and adjusting means for adjusting, in accordance with the compensation data, the first voltage so as to cause an absolute value of a difference between the first voltage and the second voltage to be consistent in all frames.

According to this arrangement, liquid crystal is sandwiched between the pixel electrode and common electrode, and while the first voltage for gradation displaying, the voltage changing in accordance with the display data, is applied to the pixel electrode, the second voltage is applied to the common electrode. The first and second voltages applied to the respective electrodes change the optical transmittance of the liquid crystal pixel, and the gradation displaying is carried out in accordance with this change.

In order to secure long-term reliability of the liquid crystal, AC conversion is carried out by changing the first and second voltages on a frame-by-frame basis. Concerning this, when an absolute value of the difference between the first and second voltages is not consistent in all frames, the optical transmittance of the liquid crystal pixel is different in each frame, causing significant deterioration of the display quality.

To resolve this problem, the above-mentioned liquid crystal driving device is arranged in such a manner that, the compensation data is stored in the storing means, and in accordance with this compensation data, the first voltage is adjusted by the adjusting means, in order to cause an absolute value of the difference between the first and second voltages is consistent in all frames. With this, the absolute value of the difference between the first and second voltages is consistent in all frames, and thus the optical transmittance of the liquid crystal pixel is consistent in all frames and the display quality significantly improves.

Further, since the storing means for storing the compensation data is provided in the liquid crystal driving device, it is unnecessary to provide external compensation means which has conventionally been required, and this makes it possible to simplify the arrangement and reduce the costs. Once the compensation data is stored in the storing means, the adjustment is automatically carried out by the adjusting means, so that the adjustment operation is significantly simplified and thus irrespective of one's skill, the adjustment can be stably carried out by everyone.

For a fuller understanding of the nature and advantages of the invention, reference should be made to the ensuing detailed description taken in conjunction with the accompanying drawings.

DESCRIPTION OF THE EMBODIMENTS

Figure 1:
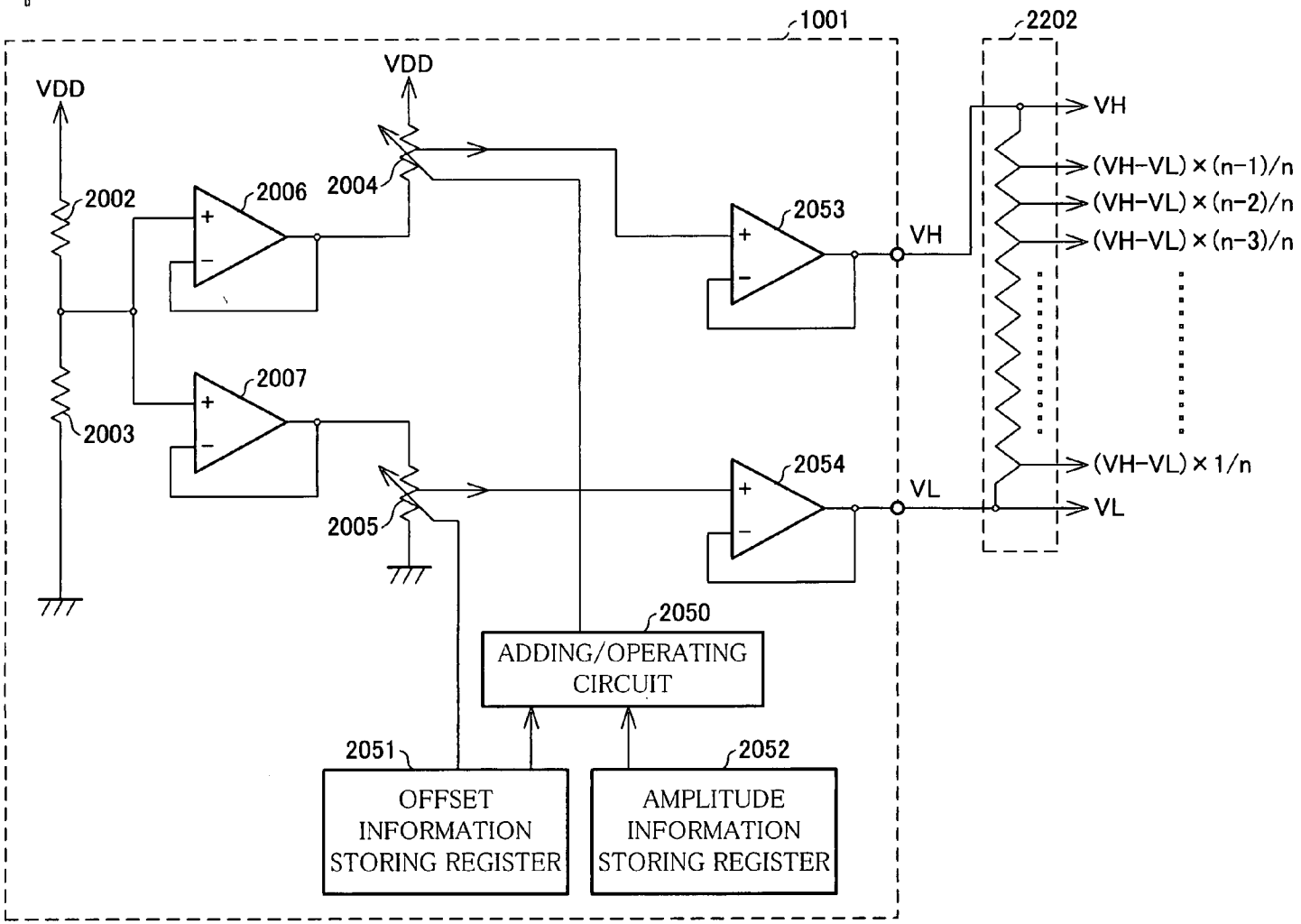
FIG. 1 is a circuit diagram, illustrating an example of a voltage generation circuit of a liquid crystal driving device in accordance with the present invention.
Figure 2:
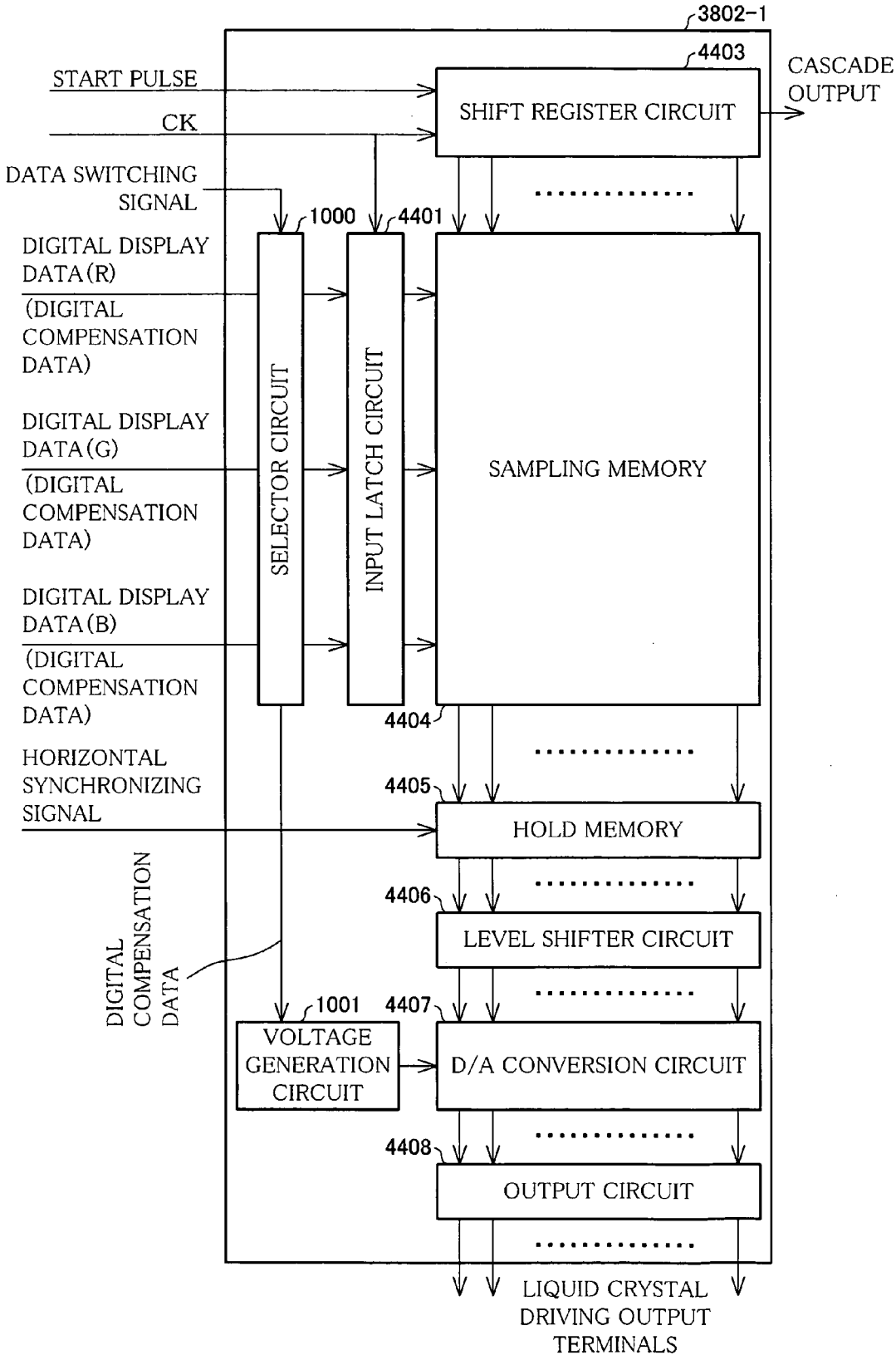
FIG. 2 is a block diagram, illustrating an example of a source driver IC of the liquid crystal driving device.

The following will describe an embodiment of the present invention with reference to FIGS. 1 and 2.

Figure 5:
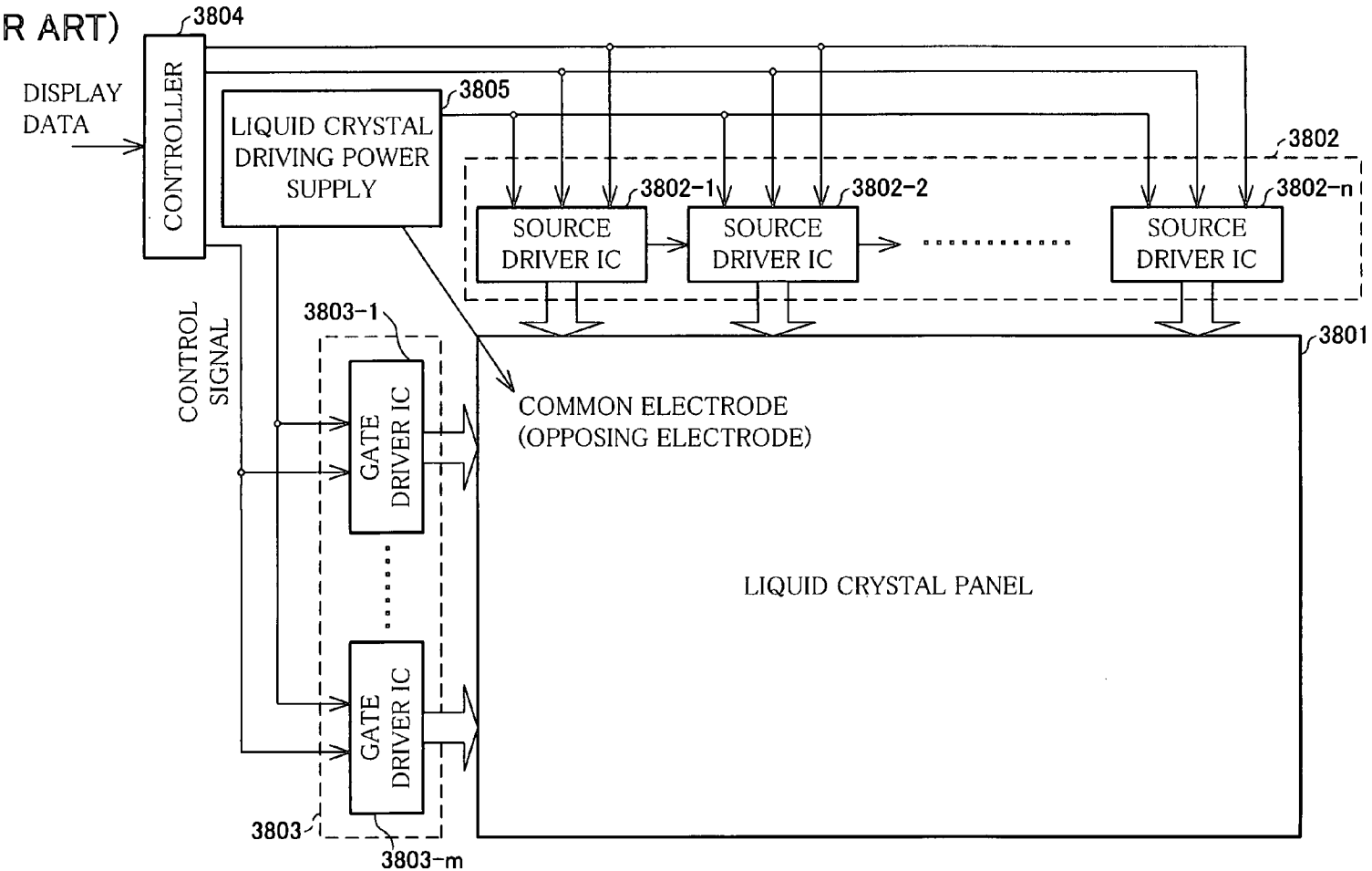
FIG. 5 (PRIOR ART)
FIG. 5 is a block diagram, showing an overall arrangement of a conventional display device.

FIG. 2 illustrates an example of a source driver of a liquid crystal driving device in accordance with the present invention. Note that, members having the same functions as those described in the arrangements having been described with reference to FIGS. 5 and 6 are given the same numbers, so that the descriptions are omitted for the sake of convenience.

Figure 6:
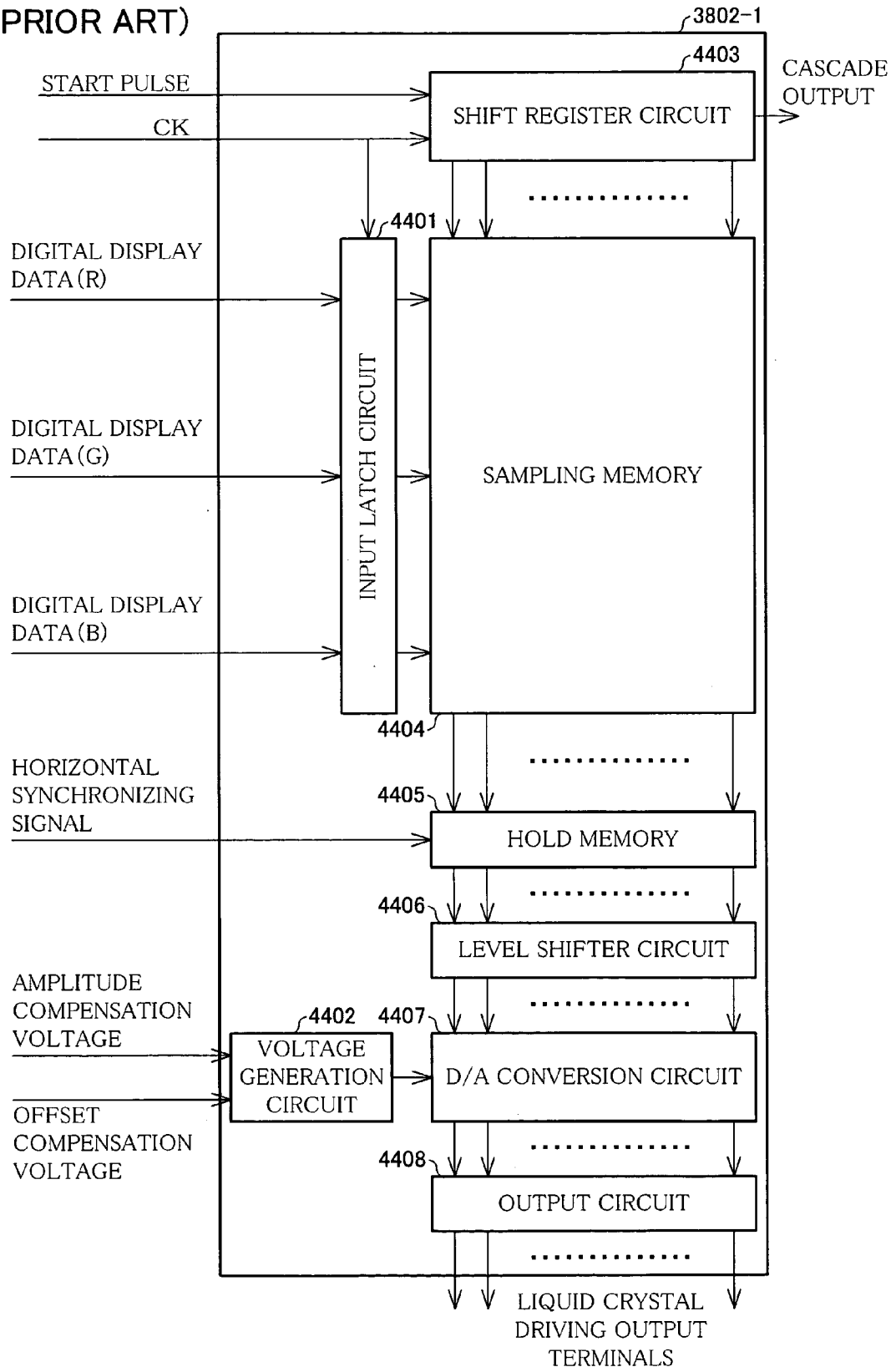
FIG. 6 (PRIOR ART)
FIG. 6 is a block diagram, showing a conventional source driver IC.
Figure 7:
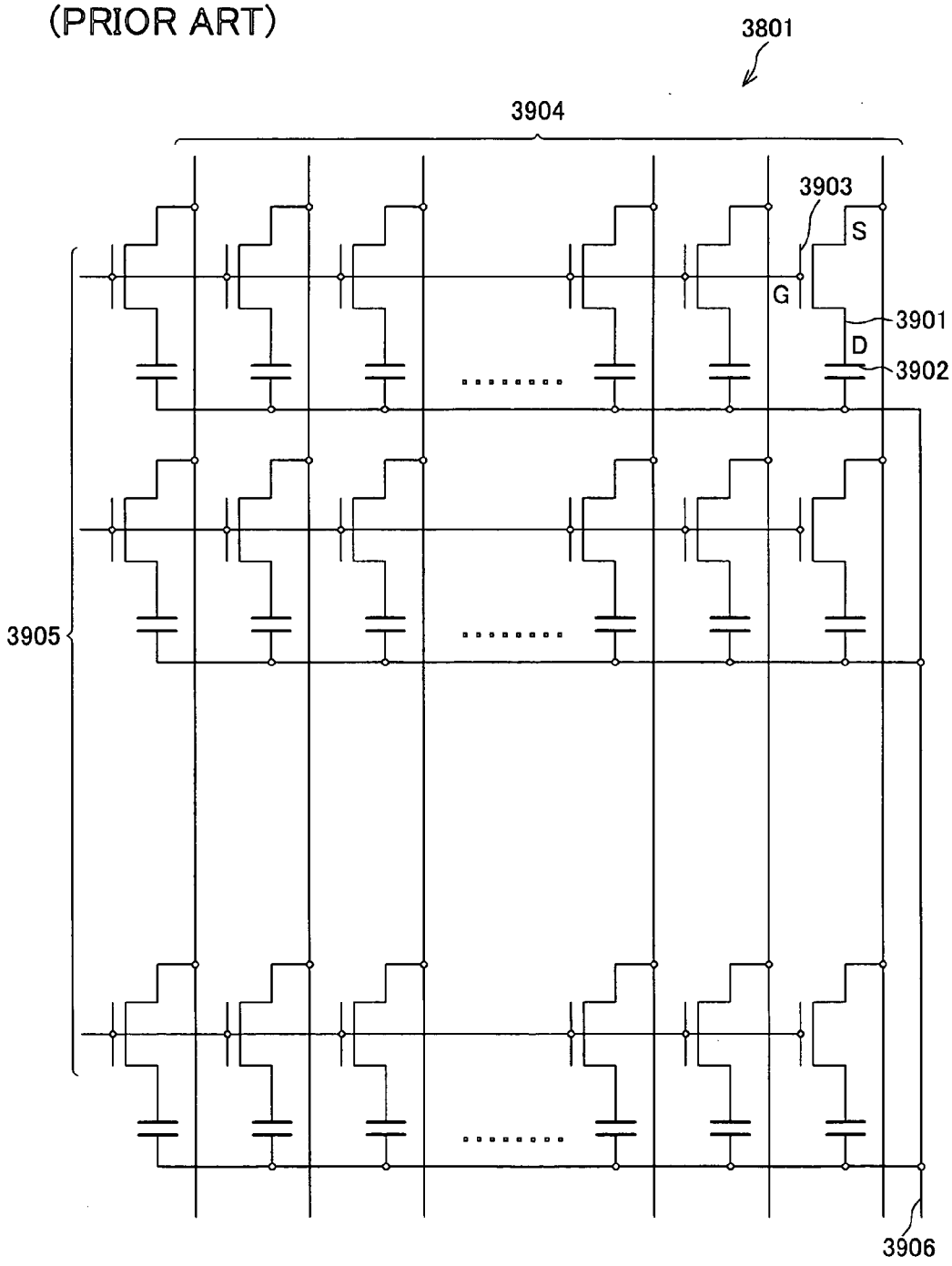
FIG. 7 (PRIOR ART)
FIG. 7 is circuit diagram roughly illustrating an example of a display panel, and describing a conventional art and the present invention.
Figure 8:
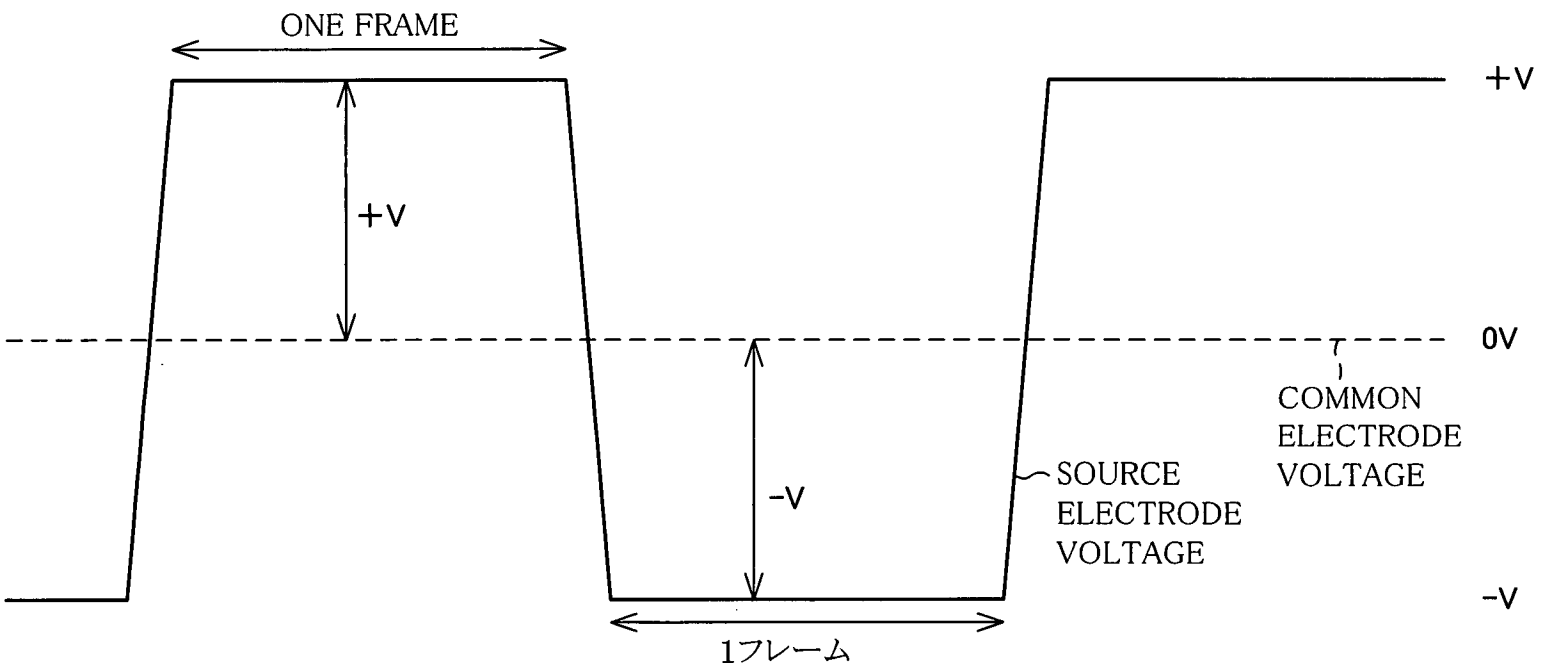
FIG. 8 (PRIOR ART)
FIG. 8 is an waveform chart, illustrating AC driving.
Figure 9:
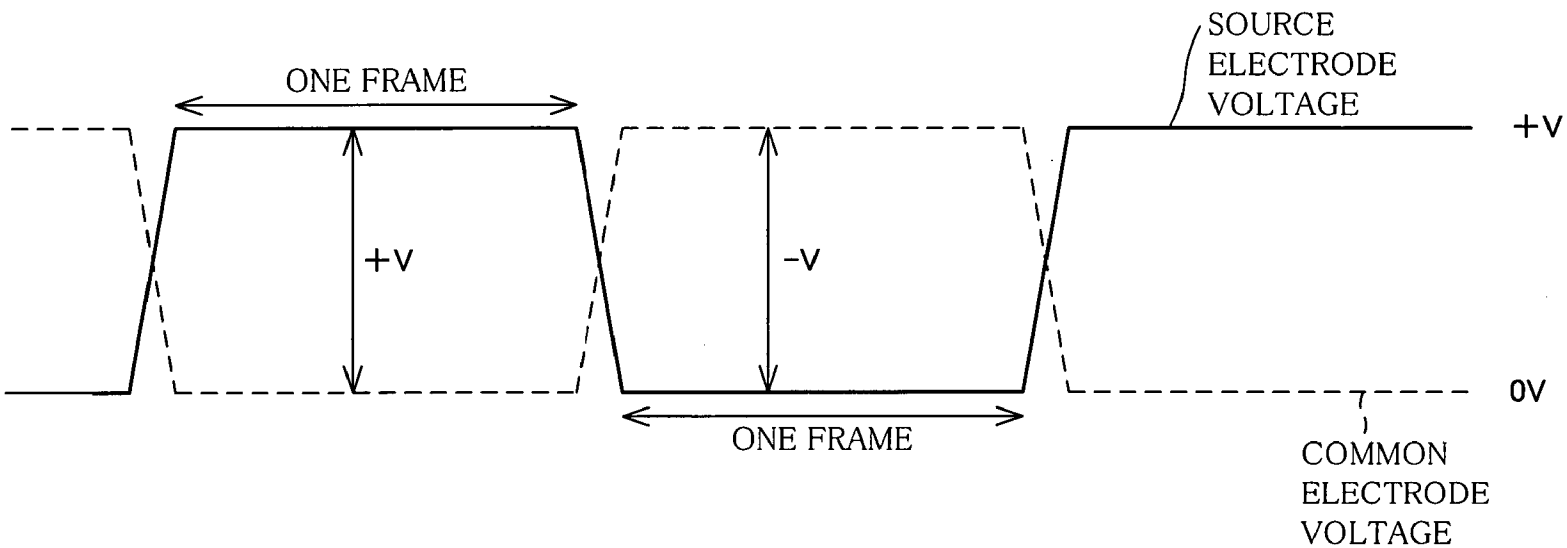
FIG. 9 (PRIOR ART)
FIG. 9 is an waveform chart, illustrating another example of the AC driving.
Figure 10:
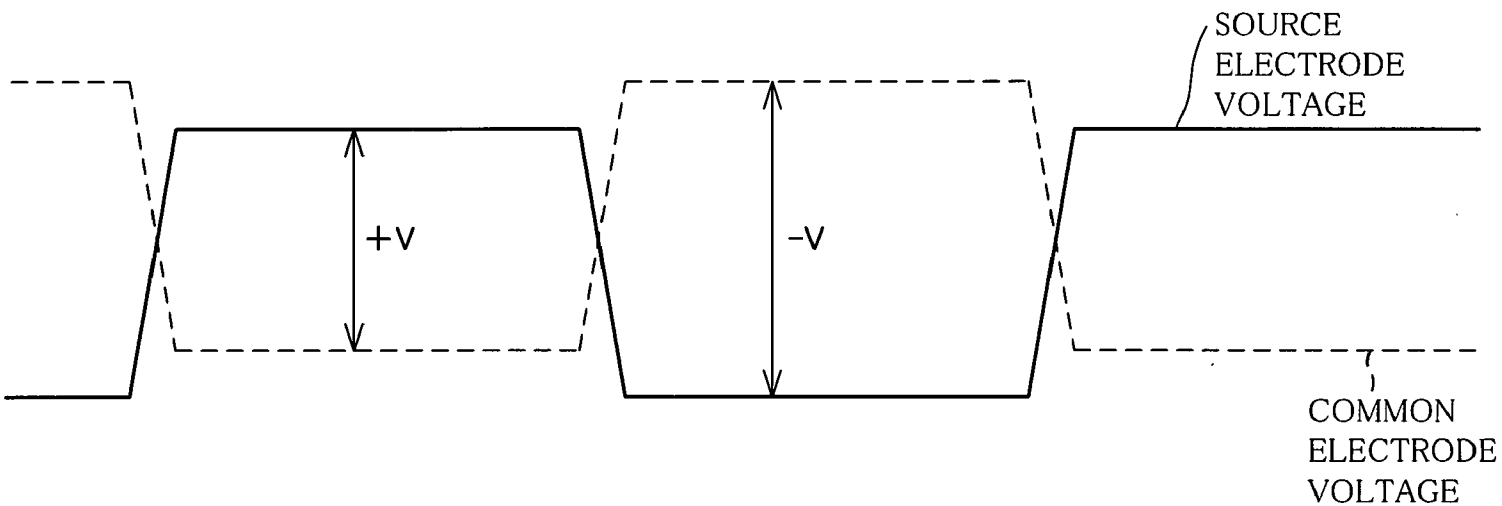
FIG. 10 (PRIOR ART)
FIG. 10 is an waveform chart, illustrating a case when absolute values concerning the differences between source electrode voltages and common electrode voltages are not equal to each other.

A source driver IC 3802-1 in FIG. 2 is different from the source driver IC 3802-1 in FIG. 6, to the extent that a selector circuit 1000 is additionally provided in the previous stage of an input latch circuit 4401, and a voltage generation circuit 1001, which is different from a voltage generation circuit 4402, is provided in place of the circuit 4402.

Display data supplied from the outside is converted to digital signals (R, G, and B signals; hereinafter, these digital signals will be referred to as sets of digital display data (R), (G), and (B), and will be correctively termed digital display data) by a control circuit 3804 (cf. FIG. 5), and then supplied to the selector circuit 1000 in the source driver IC 3802-1 as in FIG. 2.

To the selector circuit 1000, compensation data (hereinafter, will be referred to as sets of digital compensation data (R), (G), and (B), and will be correctively termed digital compensation data) is supplied from the control circuit 3804, via a line through which the sets of digital display data (R), (G), and (B) are also transmitted.

Since the digital compensation data and digital display data are supplied through an identical line, it is unnecessary to additionally provide an input terminal and transmission line for the digital compensation data, and this makes it possible to simplify the arrangement. Also, the input of the digital compensation data is carried out in a similar manner with the input of the digital display data, and hence no special mechanism is required and no limitation to the module arrangement is placed.

In accordance with a data switching signal from the control circuit 3804, the selector circuit 1000 selects either the supply of the digital compensation data to the voltage generation circuit 1001 or the supply of the digital display data to the input latch circuit 4401.

The digital compensation data is, for instance, supplied from the control circuit 3804 to the source driver IC 3802-1 at the moment of turning the liquid crystal device on, and normal digital display data is outputted thereafter. However, the present invention is not limited to this arrangement so that any arrangements can be arbitrarily adopted as long as the digital compensation data is supplied to the selector circuit 1000 via the line through which the digital display data is also transmitted. With this arrangement, the digital compensation data is supplied to the selector circuit 1000 via the line through which the digital display data is also transmitted so that it is totally unnecessary to provide additional lines and terminals.

Now, FIG. 1 shows an example of the voltage generation circuit 1001. Referring to FIGS. 1 and 2, the voltage generation circuit 1001 will be described as below.

The switching between the digital display data and digital compensation data is carried out in the selector circuit 1000 in accordance with the above-mentioned data switching signal, and either of them is outputted from the selector circuit 1000. The selector circuit 1000 discriminates, in accordance with the data switching signal, between the digital display data and digital compensation data. If supplied data is the digital display data, the data is supplied to the input latch circuit 4401, and if supplied data is the digital compensation data, the data is supplied to the voltage generation circuit 1001.

The voltage generation circuit 1001 is, as FIG. 1 shows, provided with an offset information storing register 2051, amplitude information storing register 2052, and adding/operating circuit 2050. The amplitude information storing register 2052 is a storing section for storing the digital compensation data, and the digital compensation data is generated by converting the offset information and amplitude information to a digital signal.

The voltage generation circuit 1001 is further provided with resistors 2002 and 2003 for dividing a power supply voltage VDD, and performs outputting to noninversion input terminals of voltage-follower operations amplifiers 2006 and 2007 with reference to voltages generated by the division (i.e. voltages at the both ends of the register 2003).

The reference voltage having been subjected to impedance lowering in the operational amplifier 2006 is pulled up to the power supply voltage VDD by the variable resistor 2004, and the output from the variable resistor 2004 is, as the maximum gradation display voltage VH, supplied to the resistance dividing circuit 2202 via a voltage-follower operational amplifier 2053.

In the meantime, the reference voltage having been subjected to low-impedance conversion in the operational amplifier 2007 is pulled down to the ground line by the variable resistor 2005, and the output of the variable resistor 2005 is, as the minimum gradation display voltage VL, supplied to the resistance dividing circuit 2202 via a voltage-follower operational amplifier 2054.

The variable resistor 2004 varies its resistance value in accordance with an output signal from the adding/operating circuit 2050. Similarly, the variable resistor 2005 varies its resistance value in accordance with a value of the offset information storing register 2051.

In this manner, the maximum gradation display voltage VH and minimum gradation display voltage VL can be varied (adjusted) only by changing the output signal from the adding/operating circuit and the value of the offset information storing register 2051.

The variable resistors 2004 and 2005 can be made up of conventional circuits. For instance, each of the variable resistors 2004 and 2005 may be arranged in such a manner that a plurality of resistors are connected in series and a plurality of analog switches are connected in parallel to the both ends of each resistor, and the switching of these analog switches is carried out in accordance with the digital compensation data so that the resistance values are varied.

Realizing these resistors and analog switches by integrated circuits allows the liquid crystal driving device to reduce the number of its components and the number of manufacturing steps, so that the cost reduction can be realized.

In the variable resistor 2004, the switching of the analog switches is carried out by controlling the output signal from the adding/operating circuit 2050, so that the ratio between (i) a value of the resistance between the noninversion input terminal of the operational amplifier 2053 and the power supply voltage VDD and (ii) a value of the resistance between the noninversion input terminal of the operational amplifier 2053 and the output terminal of the operational amplifier 2006 is varied, and this causes the voltage applied to the noninversion input terminal (this voltage is equal to the maximum gradation display voltage VH) to be varied. Then the varied voltage is, as the maximum gradation display voltage VH, supplied to the resistance dividing circuit 2202 via the operational amplifier 2053.

Similarly, in the variable resistor 2005, the switching of the analog switches is carried out by controlling (varying) the value of the offset information storing resister 2051, so that the ratio between (i) a value of the resistance between the noninversion input terminal of the operational amplifier 2054 and the output terminal of the operational amplifier 2007 and (ii) a value of the resistance between the noninversion input terminal of the operational amplifier 2054 and the ground is varied, and this causes the voltage applied to the noninversion input terminal (this voltage is equal to the minimum gradation display voltage VL) to be varied. Then the varied voltage is, as the minimum gradation display voltage VL, supplied to the resistance dividing circuit 2202 via the operational amplifier 2054.

According to the example shown in FIG. 1, the variable resistor 2004 controlling the maximum gradation display voltage VH is arranged in such a manner that the ratio of the resistances is varied in accordance with the result of the addition of the value of the amplitude information storing register 2052 to the value of the offset information storing register 2051, the addition being carried out in the adding/operating circuit 2050.

In this manner, the difference between the voltage supplied to the common electrode and the amplitude voltage is adjusted by varying the value of the amplitude information storing register 2052. Further, when the value of the offset information storing register 2051 is varied in order to adjust the minimum gradation display voltage VL, the adjustable range of the minimum gradation display voltage VL is, in the adding/operating circuit 2050, reflected to the maximum gradation display voltage VH.

As described above, according to the arrangement shown in FIG. 1, in each frame, it is possible to equalize (i) an absolute value of the difference between the maximum gradation display voltage VH of the output voltage from the source driver IC 3802-1 and the voltage applied to the common electrode with (ii) an absolute value of the difference between the minimum gradation display voltage VL of the above-mentioned output voltage and the voltage applied to the common electrode. With this arrangement, since the absolute value is constant in all frames, the transmittance of the liquid crystal pixel is identical in all frames and hence the display quality is significantly improved.

Further, since the source driver IC 3802-1 includes the adding/operating circuit 2050, offset information storing register 2051, and amplitude information storing register 2052, it is unnecessary to additionally provide external compensation means which has conventionally been required, and thus the simplification and cost reduction can be realized. Moreover, since the adjustment can be fulfilled only by storing the digital compensation data in the register, the adjustment operation is significantly simplified, and thus irrespective of one's skill, the adjustment can be stably carried out by everyone.

The maximum gradation display voltage VH and minimum gradation display voltage VL are divided in the resistance dividing circuit 2202 of the next stage (the voltage range between the maximum gradation display voltage VH and minimum gradation display voltage VL is equally divided at an interval of (VH−VL)/n), so that desired gradation display voltages (e.g. when 64 gradation levels (n=64) is displayed, 64 gradation display levels) are generated.

When the amplitude information storing register 2052 and offset information storing register 2051 in FIG. 1 are made up of a nonvolatile memory and ferroelectric memory (FE-RAM) which are electrically rewritable, it is possible to ship the products after adjusting the display quality by writing the digital compensation data therein.

When means for writing the digital compensation data is prepared, the adjustment of the maximum gradation display voltage VH and minimum gradation display voltage VL can be easily performed even after the shipping, by writing the digital compensation data through the control circuit 3804. In this case, if more than one set of information can be stored, fine adjustment after the shipping can be easily performed.

The offset information storing register 2051 and amplitude information storing register 2052 may be made up of nonvolatile memories or latch circuits, and only store the digital compensation data supplied from the control circuit 3804, before the operation.

Now, referring to FIG. 3, another example of the voltage generation circuit 1001 will be described below. Note that, members having the same functions as those described in the arrangements having been described with reference to FIGS. 1 and 11 are given the same numbers, so that the descriptions are omitted for the sake of convenience.

Figure 3:
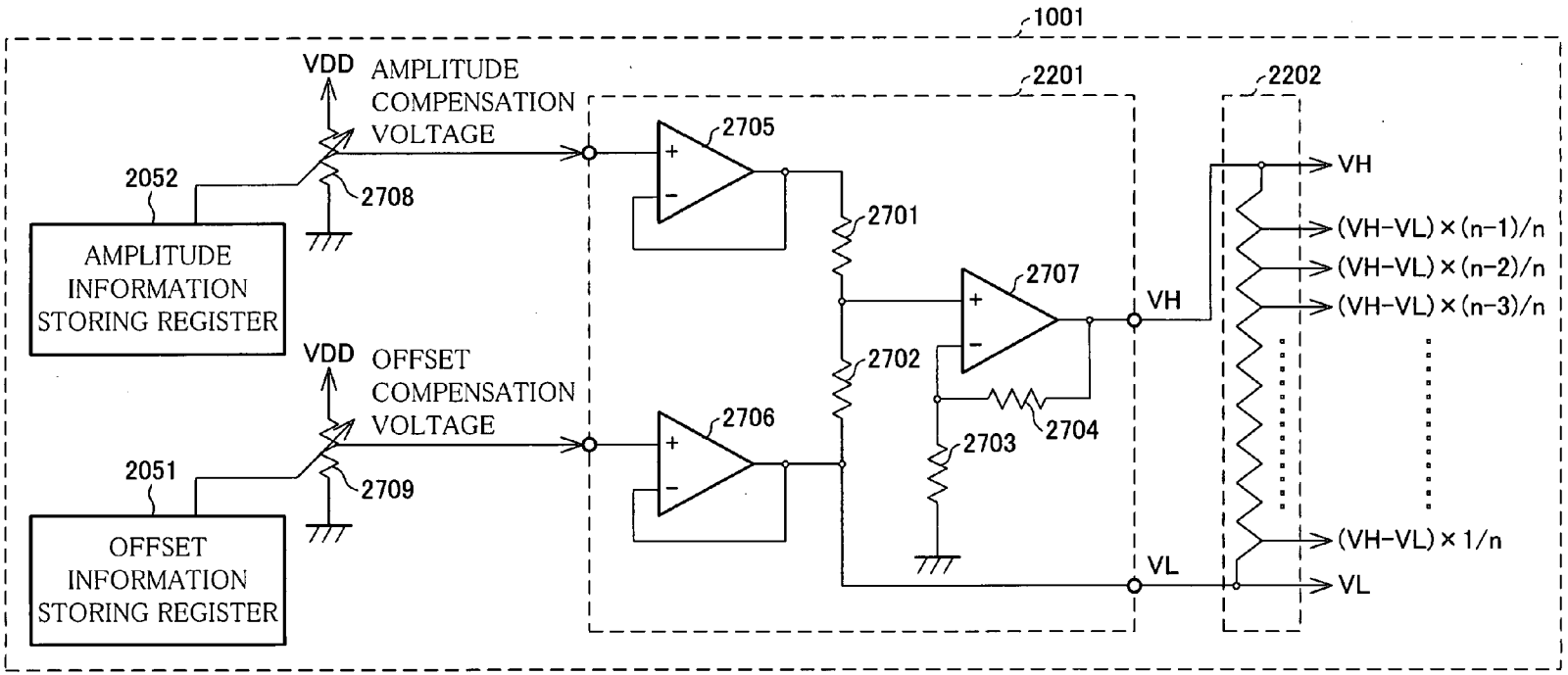
FIG. 3 is a circuit diagram, illustrating an example of the voltage generation circuit.
Figure 11:
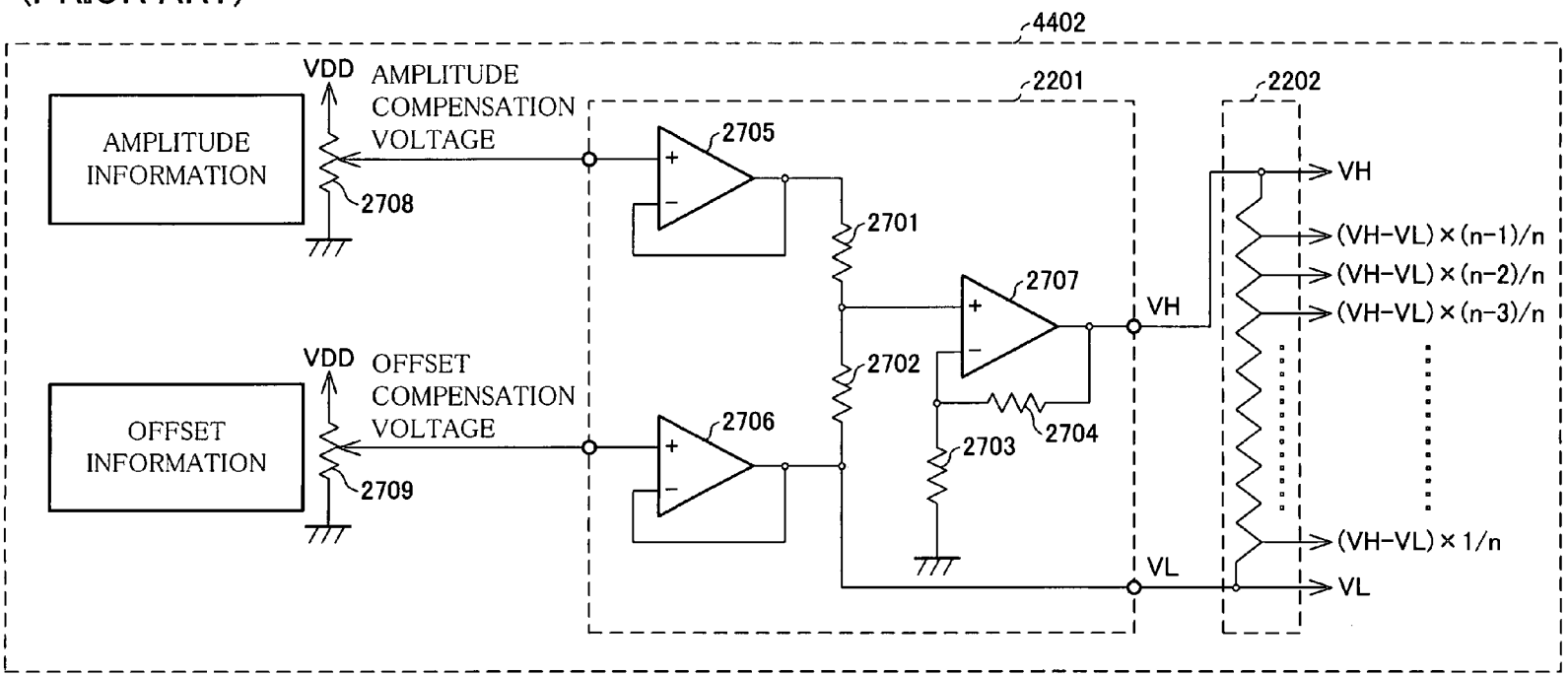
FIG. 11 (PRIOR ART)
FIG. 11 is a circuit diagram, showing a conventional voltage generation circuit.

A member 2202 in FIG. 3 is identical with the circuit in FIG. 11. A variable resistor 2708 may be arranged in such a manner that, for instance, a plurality of resistors are connected in series between a power supply voltage VDD and a ground voltage (ground), and to the both ends of each resistor, analog switches are connected in parallel.

The switching of the analog switches is controlled in accordance with digital compensation data stored in an amplitude information storing register 2052, so that the ratio between (i) a value of the resistance between a noninversion input terminal of a voltage-follower operational amplifier 2705 and the power supply voltage VDD and (ii) a value of the resistance between the noninversion input terminal of the voltage-follower operational amplifier 2705 and the ground is varied, and this causes an amplitude compensation voltage applied to the noninversion input terminal to be varied.

A variable resistor 2709 is identical with the above-mentioned variable resistor 2708. In the variable resistor 2709, the switching of the analog switches connected in parallel to the both ends of each resistor is controlled in accordance with the digital compensation data stored in the offset information storing register 2051, so that the ratio between (i) a value of the resistance between a noninversion input terminal of a voltage-follower operational amplifier 2706 and the power supply voltage VDD and (ii) a value of the resistance between the noninversion input terminal of the voltage-follower operational amplifier 2706 and the ground is varied. In this manner, the variable resistor 2709 varies the offset compensation voltage applied to the noninversion input terminal.

Since these resistors and analog switches are realized by integrated circuits, the number of components of the liquid crystal driving device is reduced, the number of steps for manufacturing the products is also reduced, and thus the cost reduction can be performed.

The amplitude information storing register 2052 and offset information storing register 2051 are identical with the identically-numbered registers in FIG. 1.

As in FIG. 3, the offset compensation voltage is subjected to low impedance conversion in the operational amplifier 2706, and then as the minimum gradation display voltage VL, supplied to the resistance dividing circuit 2202. Meanwhile, the amplitude compensation voltage is subjected to low impedance conversion in the operational amplifier 2705, and then applied to one end of the resistor 2701. The other end of the resistor 2701 is connected to the noninversion input terminal of the operational amplifier 2707 and one end of the resistor 2702. To the other end of the resistor 2702, the minimum gradation display voltage VL is applied.

Assume that, for instance, digital compensation data corresponding to the amplitude compensation voltage of 4.6V is stored in the amplitude information storing register 2052, and digital compensation data corresponding to the offset compensation voltage of 0.2V is stored in the offset information storing register 2051 (this assumption corresponds to a case where an amplitude waveform within the range of 0.2–4.8V is applied to the common electrode). Further, assume that the resistors 2701 and 2702 have identical resistance values, and the resistors 2703 and 2704 have identical resistance values. In this instance, as in the arrangement shown in FIG. 11, a voltage of 4.8V is supplied from the output terminal of the operational amplifier 2707 to the resistance dividing circuit 2202, as the maximum gradation display voltage VH. Note that, the minimum gradation display voltage VL is 0.2V.

In this manner, the maximum gradation display voltage VH and minimum gradation display voltage VL can be adjusted in accordance with the sets of digital compensation data stored in the amplitude information storing register 2052 and offset information storing register 2051, respectively. With this arrangement, in any one of frames, it is possible to equalize (i) an absolute value of the difference between the maximum gradation display voltage VH of the output voltage from the source driver IC 3802-1 and the voltage applied to the common electrode with (ii) an absolute value of the difference between the minimum gradation display voltage VL of the foregoing output voltage and the voltage applied to the common electrode.

In the arrangement having been described with reference to FIG. 3, the data for generating the amplitude compensation voltage may be produced after adding, by the adding/operating circuit 2050, the digital compensation data from the offset information storing register 2051 to the digital compensation data from the amplitude information storing register 2052, as in the arrangement in FIG. 1. In this case, the addition of the minimum gradation display voltage VL is not required in the generation of the amplitude compensation voltage.

Figure 4:
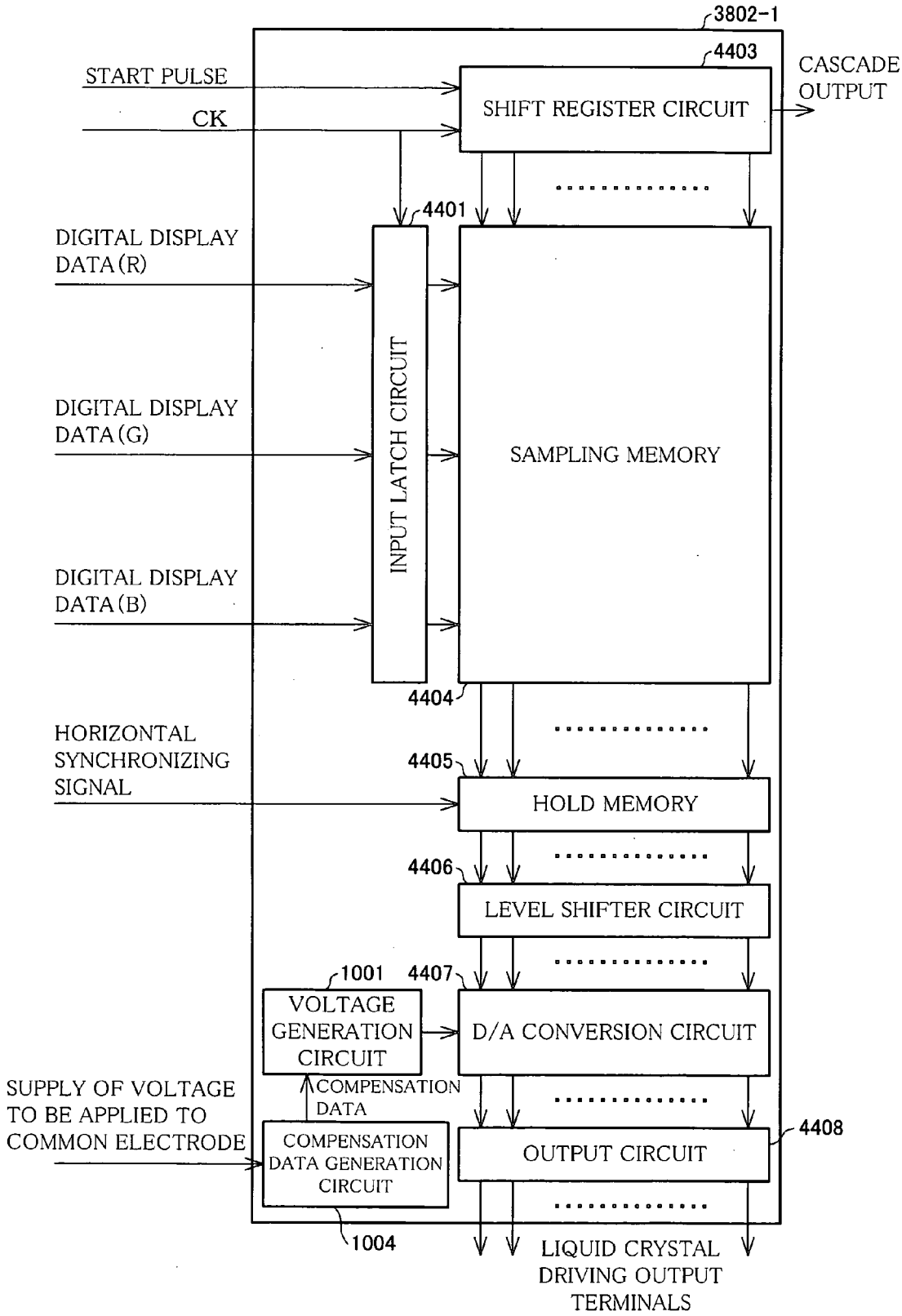
FIG. 4 is a block diagram, illustrating another example of the source driver IC of the liquid crystal driving device.

FIG. 4 illustrates another example of the source driver IC 3802-1 of the liquid crystal driving device in accordance with the present invention. The arrangement in FIG. 4 is different from the arrangement in FIG. 2, to the extent that the arrangement in FIG. 4 is further provided with a compensation data generation circuit 1004 which (i) receives a voltage applied to the common electrode instead of receiving digital compensation data, (ii) generates digital compensation data in accordance with the received voltage, and (iii) supplies the generated digital compensation data to the voltage generation circuit 1001. Note that, members having the same functions as those described in the arrangements having been described with reference to FIGS. 2 are given the same numbers, so that the descriptions are omitted for the sake of convenience.

The compensation data generation circuit 1004 at least includes, for instance, an A/D conversion circuit (conversion means) for converting the supplied common electrode voltage from analog to digital, and a latch circuit (holding means) for holding the lowest level (data concerning the minimum gradation display voltage VL) and the highest level (data concerning the maximum gradation display voltage VH), in accordance with the result of the conversion. The compensation data generation circuit 1004 may be further provided with an operating circuit (adder or subtracter) if fine adjustment is further required.

The compensation data is supplied to the voltage generation circuit 1001, and a compensated gradation display voltage is generated therein. Note that, this voltage generation circuit 1001 may be identical with the voltage generation circuit 1001 in FIG. 1 or 3.

According to the arrangement in FIG. 4, the voltage supplied to the common electrode is detected in the compensation data generation circuit 1004, and in accordance with this voltage, the adjustment of the maximum gradation display voltage VH and minimum gradation display voltage VL can be automatically carried out.

As described above, according to the arrangement in FIG. 4, the amplitude voltage and offset voltage of an waveform outputted from the source driver IC 3802-1 can be easily adjusted, so that an absolute value of the voltage applied to the liquid crystal pixel, the voltage being generated from the respective output voltages from the common electrode and source driver IC 3802-1, is constant in all frames, and thus it is possible to significantly improve the display quality certainly as well as easily.

Also, according to the arrangement above, the compensation data generation circuit 1004 is provided in the source driver UC 3802-1 and the offset adjustment is carried out inside the source driver IC 3802-1. For this reason, it is possible to reduce the number of external voltage compensation members.

Since the offset adjustment can be carried out by changing a value written into the internal register, the offset adjustment is simplified.

Moreover, by adopting detecting means for, for instance, detecting the voltage supplied to the common electrode, it is possible to automatically carry out the voltage adjustment of the maximum gradation display voltage VH and minimum gradation display voltage VL.

Hereinbefore, the example in which the compensation data generation circuit 1004 is provided in the source driver IC 3802-1 has been described. However, the present invention is not limited to this arrangement so that there is such an alternative arrangement that the compensation data generation circuit 1004 is provided in the control circuit 3804 and the compensation data is supplied to the source driver IC 3802-1.

As stated above, a liquid crystal driving device in accordance with the present invention, which drives a liquid crystal pixel between a pixel electrode and common electrode opposing the pixel electrode, by carrying out AC conversion by changing a first voltage for gradation displaying and a second voltage on a frame-by-frame basis, the first voltage changing in accordance with display data and being applied to the pixel electrode and the second voltage being applied to the common electrode, comprises: storing means for storing compensation data; and adjusting means for adjusting, in accordance with the compensation data, the first voltage so as to cause an absolute value of a difference between the first voltage and the second voltage to be consistent in all frames.

According to this arrangement, liquid crystal is sandwiched between the pixel electrode and common electrode, and while the first voltage for gradation displaying, the voltage changing in accordance with the display data, is applied to the pixel electrode, the second voltage is applied to the common electrode. The first and second voltages applied to the respective electrodes change the optical transmittance of the liquid crystal pixel, and the gradation displaying is carried out in accordance with this change.

In order to secure long-term reliability of the liquid crystal, AC conversion is carried out by changing the first and second voltages on a frame-by-frame basis. Concerning this, when an absolute value of the difference between the first and second voltages is not consistent in all frames, the optical transmittance of the liquid crystal pixel is different in each frame, causing significant deterioration of the display quality.

To resolve this problem, the above-mentioned liquid crystal driving device is arranged in such a manner that, the compensation data is stored in the storing means, and in accordance with this compensation data, the first voltage is adjusted by the adjusting means, in order to cause an absolute value of the difference between the first and second voltages is consistent in all frames. With this, the absolute value of the difference between the first and second voltages is consistent in all frames, and thus the optical transmittance of the liquid crystal pixel is consistent in all frames and the display quality significantly improves.

Further, since the storing means for storing the compensation data is provided in the liquid crystal driving device, it is unnecessary to provide external compensation means which has conventionally been required, and this makes it possible to simplify the arrangement and reduce the costs. Once the compensation data is stored in the storing means, the adjustment is automatically carried out by the adjusting means, so that the adjustment operation is significantly simplified and thus irrespective of one's skill, the adjustment can be stably carried out by everyone.

The compensation data is preferably made up of first data for compensating an amplitude of the first voltage and second data for compensating an offset of the first voltage. The compensation of the amplitude of the first voltage is preferably carried out in accordance with the first data and the second data. With this, since the compensation of the amplitude of the first voltage is carried out in consideration of the offset compensation, it is unnecessary to carry out fine adjustment by the adjusting means.

It is preferable that switching means, which is for switching between the display data and the compensation data supplied through a line through which the display data is also supplied, is further provided, and the compensation data is supplied from the switching means to the storing means.

In this case, since the compensation data and display data are supplied through the same line, it is unnecessary to provide an additional input terminal and transmission line, and this makes it possible to simplify the structure of the device. Further, since the input of the compensation data is carried out in a manner similar to the input of the display data, no special mechanism is required and no limitation to the module arrangement is placed.

Another liquid crystal driving device in accordance with the present invention, which drives a liquid crystal pixel between a pixel electrode and common electrode opposing the pixel electrode, by carrying out AC conversion by changing a first voltage for gradation displaying and a second voltage on a frame-by-frame basis, the first voltage changing in accordance with display data and being applied to the pixel electrode and the second voltage being applied to the common electrode, comprises: compensation data generating means for generating compensation data in accordance with the second voltage; and adjusting means for adjusting, in accordance with the compensation data having been generated, the first voltage so as to cause an absolute value of a difference between the first voltage and the second voltage to be consistent in all frames.

According to this arrangement, liquid crystal is sandwiched between the pixel electrode and common electrode, and while the first voltage for gradation displaying the voltage changing in accordance with the display data, is applied to the pixel electrode, the second voltage is applied to the common electrode. The first and second voltages applied to the respective electrodes change the optical transmittance of the liquid crystal pixel, and the gradation displaying is carried out in accordance with this change.

In order to secure long-term reliability of the liquid crystal, AC conversion is carried out by changing the first and second voltages on a frame-by-frame basis. Concerning this, when an absolute value of the difference between the first and second voltages is not consistent in all frames, the optical transmittance of the liquid crystal pixel is different in each frame, causing significant deterioration of the display quality.

To resolve this problem, in the above-mentioned liquid crystal driving device, the compensation data is generated by the compensation data generating means, in accordance with the second voltage. In accordance with the generated compensation data, the first voltage is adjusted by the adjusting means, in order to cause an absolute value of the difference between the first and second voltages to be consistent in all frames. With this, the absolute value of the difference between the first and second voltages is consistent in all frames, and thus the optical transmittance of the liquid crystal pixel is consistent in all frames and the display quality significantly improves.

Further, since the compensation data generating means for generating the compensation data is provided in the liquid crystal driving device, it is unnecessary to provide external compensation means which has conventionally been required, and this makes it possible to simplify the arrangement and reduce the costs. Once the compensation data is stored in the storing means, the adjustment is automatically carried out by the adjusting means, so that the adjustment operation is significantly simplified and thus irrespective of one's skill, the adjustment can be stably carried out by everyone.

Further, generating the compensation data in accordance with the second voltage applied to the common electrode makes it possible to carry out the automatic adjustment of the first voltage without supplying the compensation data from the outside.

The compensation data generating means preferably includes: conversion means for converting the second voltage to a digital signal; and holding means for storing a maximum value and a minimum value of the second voltage, in accordance with the digital signal.

The compensation data is preferably made up of first data for compensating an amplitude of the first voltage and second data for compensating an offset of the first voltage. The compensation of the amplitude of the first voltage is preferably carried out in accordance with the first data and the second data. With this, since the compensation of the amplitude of the first voltage is carried out in consideration of the offset compensation, it is unnecessary to carry out fine adjustment by the adjusting means.

The storing means is preferably a rewritable memory. This realizes the following points. That is, the compensation data can be written in a rewritable memory before shipment, and thus the display quality can be easily adjusted to a level required for the shipment. Moreover, the adjustment can be easily carried out by rewriting the compensation data, even after the shipment.

It is preferable that the adjusting means is a variable resistor whose resistance value varies in accordance with the compensation data, and the first voltage is adjusted in accordance with the variation of the resistance value. In this case, the variable resistor is, for instance, an integrated circuit made up of a plurality of resistors being connected in series and analog switches connected in parallel to both ends of each of the plurality of resistors, and the analog switches are switched in accordance with the compensation data. With this, the resistance value is varied, and in accordance with this variation of the resistance value, the first voltage can be adjusted.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A liquid crystal driving device which drives a liquid crystal pixel between a pixel electrode and common electrode opposing the pixel electrode, by carrying out AC conversion by changing a first voltage for gradation displaying and a second voltage on a frame-by-frame basis, the first voltage changing in accordance with display data and being applied to the pixel electrode, and the second voltage being applied to the common electrode, the liquid crystal driving device comprising:

storing means for storing compensation data; and adjusting means for adjusting, in accordance with the compensation data, the first voltage so as to cause an absolute value of a difference between the first voltage and the second voltage to be consistent in all frames.

2. The liquid crystal driving device as defined in claim 1, wherein, the compensation data is made up of first data for compensating an amplitude of the first voltage and second data for compensating an offset of the first voltage.

3. The liquid crystal driving device as defined in claim 2, wherein, compensation of the amplitude of the first voltage is carried out in accordance with the first data and the second data.

4. The liquid crystal driving device as defined in claim 1, further comprising switching means for switching between the display data and the compensation data supplied through a line through which the display data is supplied, the compensation data being supplied from the switching means to the storing means.

5. The liquid crystal driving device as defined in claim 1, wherein, the storing means is a rewritable memory.

6. The liquid crystal driving device as defined in claim 1, wherein, the adjusting means is a variable resistor whose resistance value varies in accordance with the compensation data, and the first voltage is adjusted in accordance with variation of the resistance value.

7. The liquid crystal driving device as defined in claim 6, wherein, the variable resistor is an integrated circuit made up of a plurality of resistors being connected in series and analog switches connected in parallel to both ends of each of the plurality of resistors, and the analog switches are switched in accordance with the compensation data.

8. A liquid crystal driving device which drives a liquid crystal pixel between a pixel electrode and common electrode opposing the pixel electrode, by carrying out AC conversion by changing a first voltage for gradation displaying and a second voltage on a frame-by-frame basis, the first voltage changing in accordance with display data and being applied to the pixel electrode, and the second voltage being applied to the common electrode, the liquid crystal driving device comprising:

compensation data generating means for generating compensation data in accordance with the second voltage; and adjusting means for adjusting, in accordance with the compensation data having been generated, the first voltage so as to cause an absolute value of a difference between the first voltage and the second voltage to be consistent in all frames.

9. The liquid crystal driving device as defined in claim 8, wherein, the compensation data generating means includes:

conversion means for converting the second voltage to a digital signal; and holding means for holding a maximum value and a minimum value of the second voltage, in accordance with the digital signal.

10. The liquid crystal driving device as defined in claim 8, wherein, the compensation data is made up of first data for compensating an amplitude of the first voltage and second data for compensating an offset of the first voltage.

11. The liquid crystal driving device as defined in claim 10, wherein, compensation of the amplitude of the first voltage is carried out in accordance with the first data and the second data.

12. The liquid crystal driving device as defined in claim 8, wherein, the storing means is a rewritable memory.

13. The liquid crystal driving device as defined in claim 8, wherein, the adjusting means is a variable resistor whose resistance value varies in accordance with the compensation data, and the first voltage is adjusted in accordance with variation of the resistance value.

14. The liquid crystal driving device as defined in claim 13, wherein, the variable resistor is an integrated circuit made up of a plurality of resistors being connected in series and analog switches connected in parallel to both ends of each of the plurality of resistors, and the analog switches are switched in accordance with the compensation data.

* * * * *